US011800906B2

(12) United States Patent
Furstenburg

(10) Patent No.: US 11,800,906 B2
(45) Date of Patent: Oct. 31, 2023

(54) ATHLETIC GLOVE WITH HIGH-GRIP SURFACE

(71) Applicant: Matthew Furstenburg, Parkland, FL (US)

(72) Inventor: Matthew Furstenburg, Parkland, FL (US)

( * ) Notice: Subject to any disclaimer, the term of this patent is extended or adjusted under 35 U.S.C. 154(b) by 0 days.

(21) Appl. No.: 17/392,404

(22) Filed: Aug. 3, 2021

(65) Prior Publication Data

US 2022/0030988 A1 Feb. 3, 2022

Related U.S. Application Data

(60) Provisional application No. 63/060,199, filed on Aug. 3, 2020.

(51) Int. Cl.
*A41D 19/015* (2006.01)

(52) U.S. Cl.
CPC ..... *A41D 19/01558* (2013.01)

(58) Field of Classification Search
CPC ..... A41D 19/01558; A41D 19/01547; A41D 2600/10; B29K 2995/0072; A61F 13/16
See application file for complete search history.

(56) References Cited

U.S. PATENT DOCUMENTS 3,379,560 A * 4/1968 Tharp ..... C09J 7/20 428/41.6
3,404,409 A * 10/1968 Tillotson ..... A41D 19/01547 2/167
3,441,638 A * 4/1969 Stephenson ..... B29C 55/12 264/154
4,568,596 A * 2/1986 Johnson ..... B29D 28/00 428/167
4,660,228 A * 4/1987 Ogawa ..... B32B 5/022 2/167
4,881,276 A * 11/1989 Swan ..... A41D 19/01529 2/167

(Continued)

*Primary Examiner* — Jillian K Pierorazio
(74) *Attorney, Agent, or Firm* — Whiteford, Taylor & Preston, LLP; Gregory M. Stone

(57) ABSTRACT

An athletic glove is disclosed having a high-grip surface on the palm side of the glove. The high-grip surface is formed from a panel of high-adherence material and comprises an embossed pattern that is configured to provide a high-grip surface while maintaining high tactile feedback or "feel" of the item being grasped, while maintaining maximum flexibility in the hand so as to not impede the wearer's ability to conform their hand to the intended shape when varying their grip on the item being grasped. The high-grip or high-adherence surface is formed of a high friction flexible polymer, such as silicone. To further aid in providing a high-grip configuration that maintains maximum tactile feedback and flexibility for the wearer, the embossed pattern provided on the palm side of the glove employs separate, thin (preferably about 0.35 mm in thickness) pads that are separated from one another by a small distance to maximize flexibility of the high-grip surface and to provide moisture flow channels along the palm surface of the glove. The top side of the glove (i.e., the side opposite the palm) is preferably formed of a stretchable fabric for comfort of the wearer.

9 Claims, 5 Drawing Sheets

(56) References Cited

U.S. PATENT DOCUMENTS 4,928,962 A * 5/1990 Finley ..... A63B 41/08 D5/53
4,991,842 A * 2/1991 Finley ..... A63B 41/08 D5/53
5,390,372 A * 2/1995 Hashimoto ..... A63B 71/146 2/164
5,625,900 A * 5/1997 Hayes ..... A41D 19/01529 2/168
5,768,711 A 6/1998 Wissink
5,794,266 A * 8/1998 Han ..... A41D 19/0062 2/163
6,041,438 A * 3/2000 Kirkwood ..... A41D 19/0034 2/161.1
6,044,494 A * 4/2000 Kang ..... A41D 19/01558 2/161.3
6,209,138 B1 * 4/2001 Kang ..... A41D 19/01558 2/161.3
D446,368 S * 8/2001 Pizarro ..... D28/63
6,408,442 B1 * 6/2002 Kang ..... A41D 19/01547 2/167
D511,864 S * 11/2005 VanErmen ..... D29/118
D560,314 S * 1/2008 VanErmen ..... D29/117.2
D568,003 S * 4/2008 Jaeger ..... D29/123
8,485,921 B2 7/2013 Ramirez
9,022,873 B2 5/2015 Ramirez
9,233,286 B2 * 1/2016 Batista ..... A63B 71/141
9,266,263 B1 * 2/2016 Jaeger ..... B29D 99/0067
9,669,283 B2 6/2017 Ramirez
D819,925 S * 6/2018 Merck ..... D2/617
10,334,897 B2 7/2019 Diehn et al.
D927,083 S * 8/2021 Hull ..... D29/117.2
2002/0114920 A1 * 8/2002 Scholz ..... B25G 1/10 428/167
2005/0155134 A1 * 7/2005 McLin ..... A41D 19/01523 2/161.6
2005/0229286 A1 * 10/2005 Tseng ..... A41D 19/01564 2/161.2
2006/0041991 A1 * 3/2006 Kim Sim ..... A41D 19/0062 2/168
2006/0080757 A1 * 4/2006 Beyda ..... A41D 19/01558 2/164
2006/0085884 A1 * 4/2006 Giacheri ..... A63B 71/1225 2/24
2006/0185058 A1 8/2006 McGough
2007/0150998 A1 * 7/2007 Atherton ..... A63B 71/146 2/159
2007/0245455 A1 * 10/2007 Robba ..... A63B 71/146 2/161.6
2008/0035173 A1 * 2/2008 Tuman ..... A63B 60/06 15/207.2
2008/0053157 A1 3/2008 Golding et al.
2008/0263867 A1 * 10/2008 Lo ..... A63B 41/08 29/899.1
2008/0295211 A1 * 12/2008 Lo ..... B32B 25/10 2/16
2009/0025120 A1 1/2009 Vestling
2009/0139008 A1 * 6/2009 Drab ..... A63B 71/146 2/161.3
2009/0139010 A1 * 6/2009 Bevier ..... A63B 71/148 2/163
2010/0031411 A1 2/2010 Andrews
2010/0077526 A1 * 4/2010 Smeltzer ..... A63B 71/148 2/163
2010/0242154 A1 * 9/2010 Hale ..... A41D 19/01558 2/161.8
2010/0248873 A1 * 9/2010 Cooper ..... A63B 43/008 428/196
2010/0325777 A1 12/2010 Radhakrishnan et al.
2012/0036612 A1 * 2/2012 Hull ..... A41D 19/0003 2/163
2013/0067638 A1 * 3/2013 Patkov ..... A41D 19/01547 2/167
2013/0091618 A1 * 4/2013 Tanaka ..... A41D 19/01558 2/161.8
2013/0230687 A1 * 9/2013 Chen ..... B32B 38/06 428/116
2013/0281234 A1 * 10/2013 Ramirez ..... A41F 1/06 2/161.1
2014/0041095 A1 * 2/2014 Cynn ..... A41D 19/01558 2/161.1
2014/0041096 A1 * 2/2014 Takahashi ..... A41D 19/01558 2/168
2014/0081223 A1 * 3/2014 Uematsu ..... A61F 13/023 604/307
2014/0223630 A1 * 8/2014 Johnson ..... A41D 13/0015 2/69
2014/0289931 A1 * 10/2014 Patkov ..... A41D 19/01547 2/167
2015/0128324 A1 * 5/2015 Baker ..... A41D 19/01523 2/169
2015/0143609 A1 * 5/2015 Francisco Costa ..... A41D 19/0006 2/167
2015/0143610 A1 * 5/2015 Pimentel de Oliveira ..... A41D 19/0058 2/167
2015/0290521 A1 * 10/2015 Ramirez ..... A41D 19/0017 2/161.3
2016/0029712 A1 * 2/2016 Hull ..... A41D 13/065 2/24
2016/0050993 A1 * 2/2016 Sood ..... A41D 19/01558 2/161.8
2016/0128400 A1 * 5/2016 Cookus ..... A41D 19/0089 2/164
2016/0138215 A1 * 5/2016 O'Neill ..... D06N 3/0086 2/168
2016/0158594 A1 * 6/2016 Penney ..... A63B 21/4035 264/331.13
2016/0262469 A1 * 9/2016 Fernando ..... D04B 1/28
2016/0360809 A1 * 12/2016 Ramirez ..... A41D 19/01558
2017/0013888 A1 * 1/2017 Webb ..... A41D 13/0015
2017/0055608 A1 * 3/2017 Boorsma ..... A41D 19/04
2017/0080322 A1 * 3/2017 Ramirez ..... A41D 19/0013
2017/0095019 A1 * 4/2017 Milbocker ..... A41D 19/01558
2017/0232329 A1 * 8/2017 Ramirez ..... A41D 27/28 2/161.3
2018/0027902 A1 * 2/2018 Thompson ..... A41D 19/0065
2018/0035734 A1 * 2/2018 Zhu ..... A41D 19/01529
2018/0043232 A1 2/2018 Perry
2018/0125132 A1 * 5/2018 Wong ..... A41D 19/01558
2018/0228229 A1 * 8/2018 Shatzkes ..... A41D 19/01523
2018/0369680 A1 * 12/2018 Ramirez ..... A63B 71/148
2019/0054364 A1 * 2/2019 Ramirez ..... A41D 19/0017
2019/0069618 A1 * 3/2019 Williams ..... A41D 19/01547
2019/0091547 A1 * 3/2019 Schwanke ..... A41D 19/02
2019/0134942 A1 * 5/2019 Somaschini ..... B32B 27/304
2021/0345715 A1 * 11/2021 Wong ..... B29C 48/022

* cited by examiner

ATHLETIC GLOVE WITH HIGH-GRIP SURFACE

CROSS REFERENCE TO RELATED APPLICATIONS

This application is based upon and claims the benefit of U.S. Provisional Application No. 63/060,199 titled "ATHLETIC GLOVE WITH HIGH-GRIP SURFACE," filed with the United States Patent & Trademark Office on Aug. 3, 2020, the specification of which is incorporated herein by reference in its entirety.

FIELD OF THE INVENTION

This invention relates generally to hand-worn gloves, and more particularly to an athletic glove or sports glove configured with a high-grip surface to aid in gripping a sports ball or other object.

BACKGROUND OF THE INVENTION

Sports gloves are a popular accessory used by athletes in a wide variety of sporting endeavors. Depending upon the type of sport, gloves of varying configurations have been provided to offer the athlete better control over the equipment with which they engage during a sporting event, and to hopefully offer better overall performance in such sporting events. For instance, some such glove configurations may include features intended to enhance a player's grip, such as tacky polymer coatings as disclosed in U.S. Pat. No. 10,334,897 to Diehn et al., the specification of which is incorporated herein by reference.

However, while certain configurations of such sporting gloves may improve the athlete's grip on the ball, bat, club, stick, or other equipment that they are using, often such gloves tend to reduce the natural feel that the athlete would have on that equipment if grasping with their naked hand, and some such prior known glove configurations can provide a somewhat stiff resistance against the natural squeezing and gripping movements of an athlete's hand, at least when compared to their ease of squeezing or gripping such equipment with their naked hand. Often times, the user's precise grip on such equipment is critical to accomplishing, for example, a proper and accurate pass of football, catch of a soccer ball, or the like. As a result, some players can find that the benefits that are offered by such previously known glove configurations are outweighed by the disadvantages associated with stiffened movement and reduced tactile feedback or "feel" on the equipment, and may in turn avoid use of such gloves altogether.

As a result, there remains a need in the art for an athletic glove that offers the wearer an effective high-grip surface but that likewise provides high tactile feedback or "feel" of the item being grasped, while maintaining maximum flexibility of movement of the wearer's hand.

SUMMARY OF THE INVENTION

In accordance with certain aspects of an embodiment of the invention, disclosed herein is an athletic glove provided with a high-grip surface on the palm side of the glove. The high-grip surface is formed from a panel of high-adherence material and comprises an embossed pattern that is particularly configured to (i) provide a high-grip surface while maintaining high tactile feedback or "feel" of the item being grasped (such as a football), while (ii) maintaining maximum flexibility in the hand so as to not impede the wearer's ability to conform their hand to the intended shape when varying their grip on the item being grasped.

In an exemplary configuration, the high-grip or high-adherence surface is formed of a high friction flexible polymer, which in one particular exemplary embodiment may comprise silicone. To further aid in providing a high-grip configuration that maintains maximum tactile feedback and flexibility for the wearer, the embossed pattern provided on the palm side of the glove forms separate, thin (preferably about 0.35 mm in thickness), six-sided pads that are separated from one another by a small distance to maximize flexibility of the high-grip surface and to provide moisture flow channels along the palm surface of the glove. The top side of the glove (i.e., the side opposite the palm) is preferably formed of a stretchable fabric for comfort of the wearer.

In accordance with certain aspects of an embodiment of the invention, a sports glove is provided comprising a palm side comprising a panel of high-adherence material having an embossed pattern thereon forming a plurality of separated, six-sided, raised pads, a top side opposite the palm side, the top side comprising a panel of flexible, stretchable fabric, and an interior fabric layer comprising at least one of polyester and cotton.

In accordance with further aspects of an embodiment of the invention, a sports glove is provided comprising a palm side comprising a panel of high-adherence material having an embossed pattern thereon forming a plurality of separated, raised pads, wherein the high-adherence material further comprises a high friction flexible polymer, a top side opposite the palm side, the top side comprising a panel of flexible, stretchable fabric, and an interior fabric layer comprising at least one of polyester and cotton.

Still other aspects, features and advantages of the invention are readily apparent from the following detailed description, simply by illustrating a number of particular embodiments and implementations, including the best mode contemplated for carrying out the invention. The invention is also capable of other and different embodiments, and its several details can be modified in various obvious respects, all without departing from the spirit and scope of the invention. Accordingly, the drawings and description are to be regarded as illustrative in nature, and not as restrictive.

BRIEF DESCRIPTION OF THE DRAWINGS

The numerous advantages of the present invention may be better understood by those skilled in the art by reference to the accompanying drawings in which.

DETAILED DESCRIPTION OF THE PREFERRED EMBODIMENTS

The invention may be understood by referring to the following description and accompanying drawings. This description of an embodiment, set out below to enable one to practice an implementation of the invention, is not intended to limit the preferred embodiment, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Descriptions of well-known functions and structures are omitted to enhance clarity and conciseness. The terminology used herein is for the purpose of describing particular embodiments only and is not intended to be limiting of the present disclosure. As used herein, the singular forms "a", "an" and "the" are intended to include the plural forms as well, unless the context clearly indicates otherwise. Furthermore, the use of the terms a, an, etc. does not denote a limitation of quantity, but rather denotes the presence of at least one of the referenced item.

The use of the terms "first", "second", and the like does not imply any particular order, but they are included to identify individual elements. Moreover, the use of the terms first, second, etc. does not denote any order of importance, but rather the terms first, second, etc. are used to distinguish one element from another. It will be further understood that the terms "comprises" and/or "comprising", or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Although some features may be described with respect to individual exemplary embodiments, aspects need not be limited thereto such that features from one or more exemplary embodiments may be combinable with other features from one or more exemplary embodiments.

Unless otherwise indicated, all dimensions shown in the attached drawings are exemplary only and should not be construed as limiting the scope of the invention to those specific dimensions.

Figure 1:
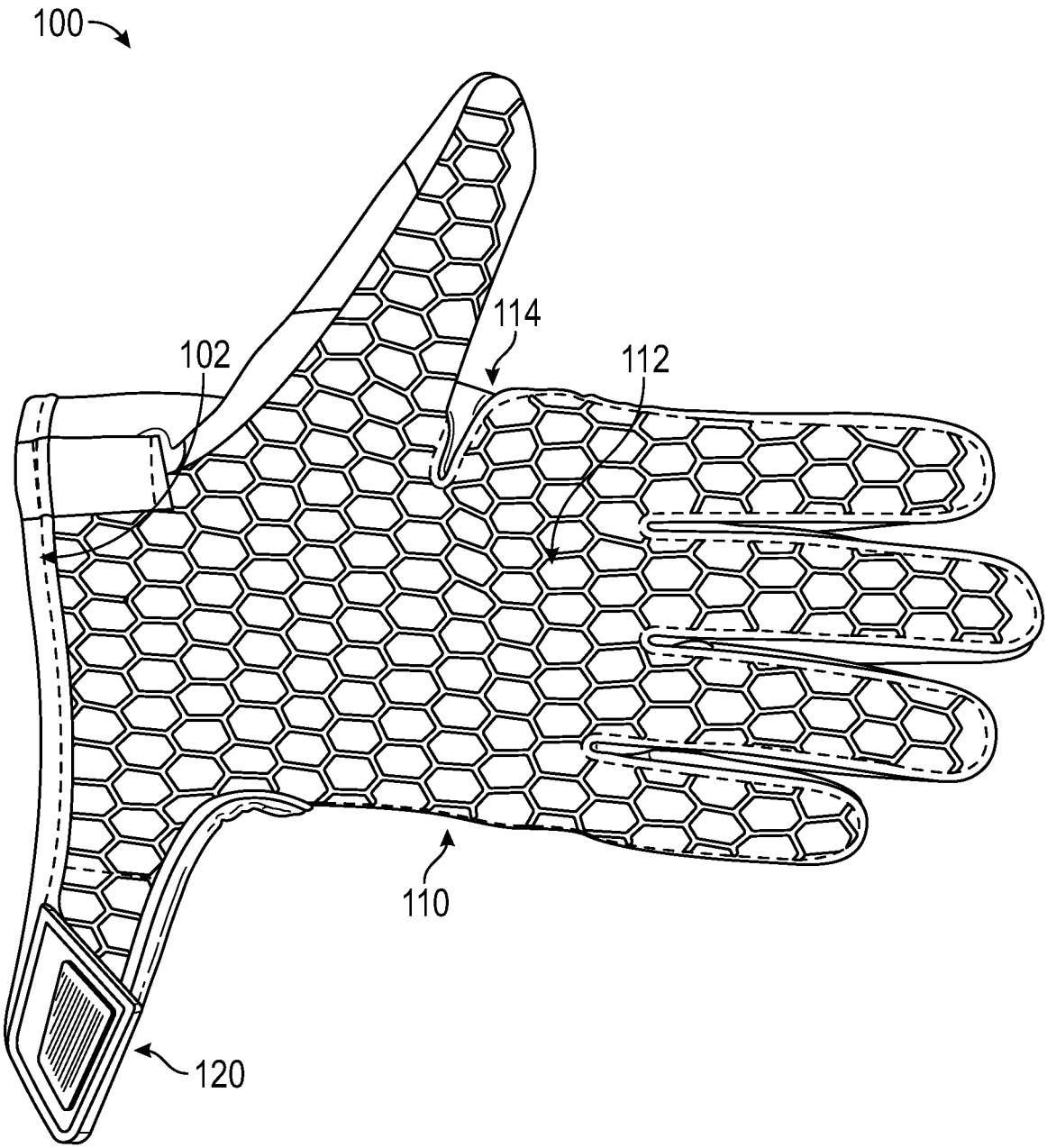
FIG. 1 is a bottom view of a sports glove showing the palm side of the glove according to certain aspects of an embodiment of the invention.
Figure 2:
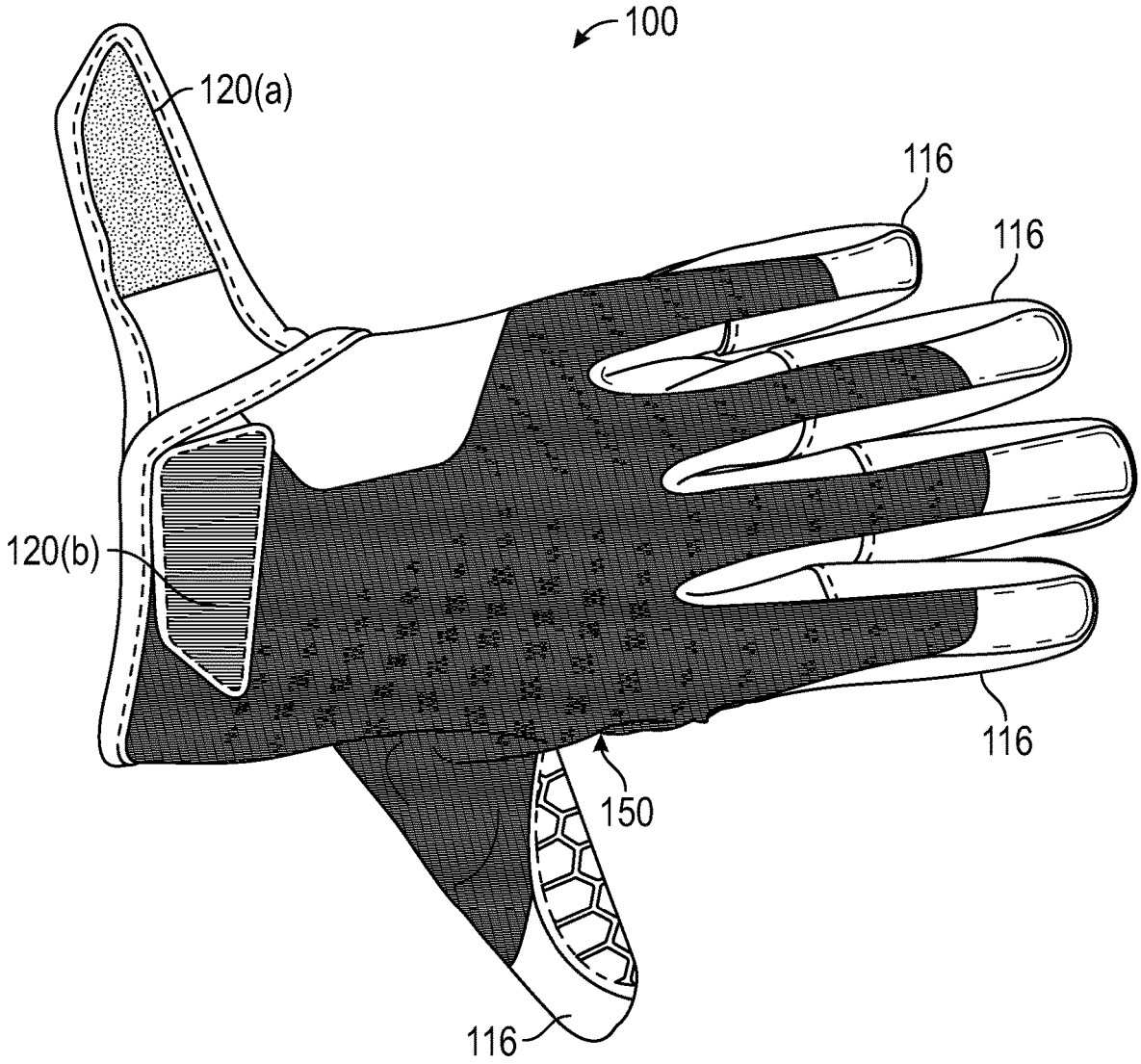
FIG. 2 is a top view of the sports glove of FIG. 1.
Figure 3:
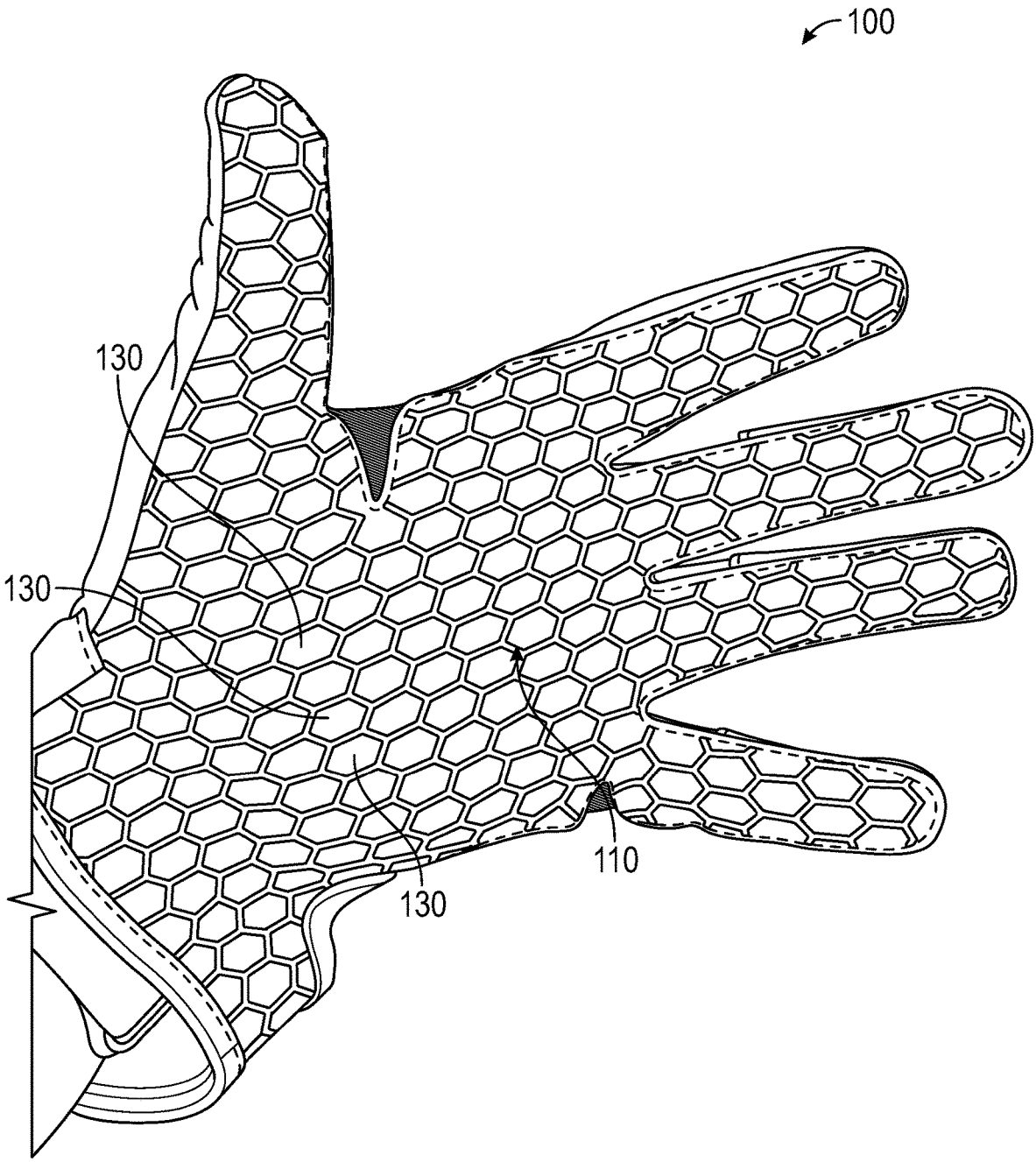
FIG. 3 is a bottom view of the sports glove of FIG. 1 and particularly displaying an embossed pattern of raised, separate six-sided pads on the palm side of the glove.
Figure 4:
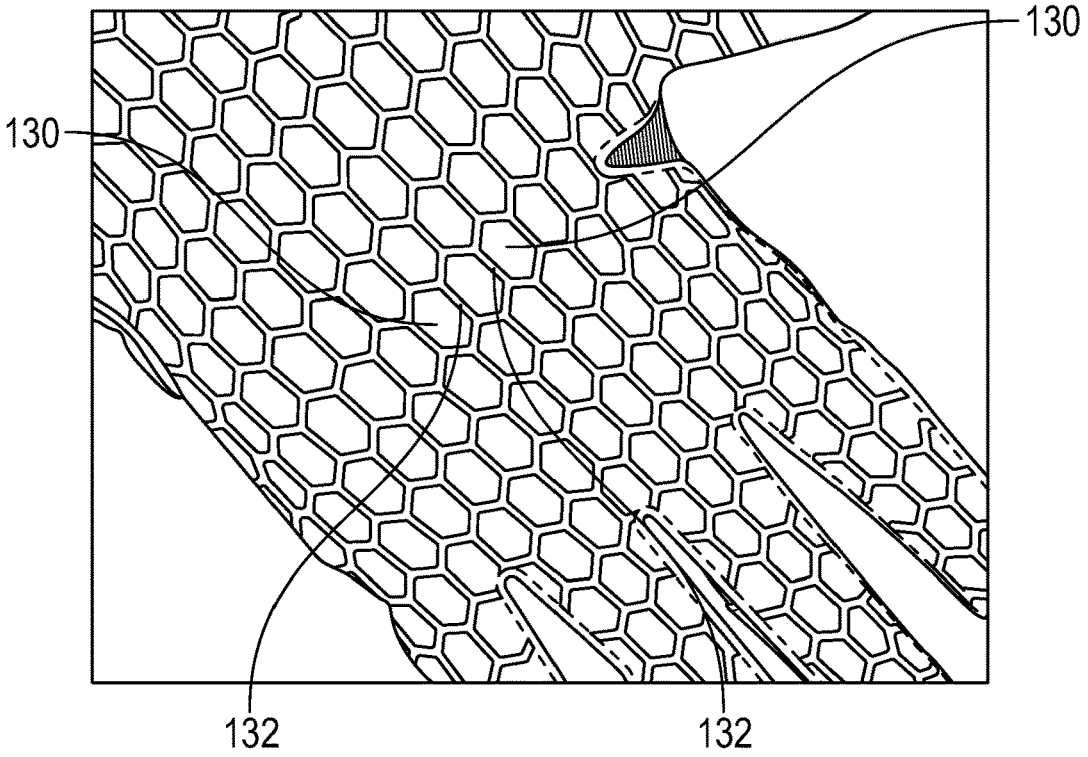
FIG. 4 is a close-up top view of the embossed pattern of FIG. 3.
Figure 5:
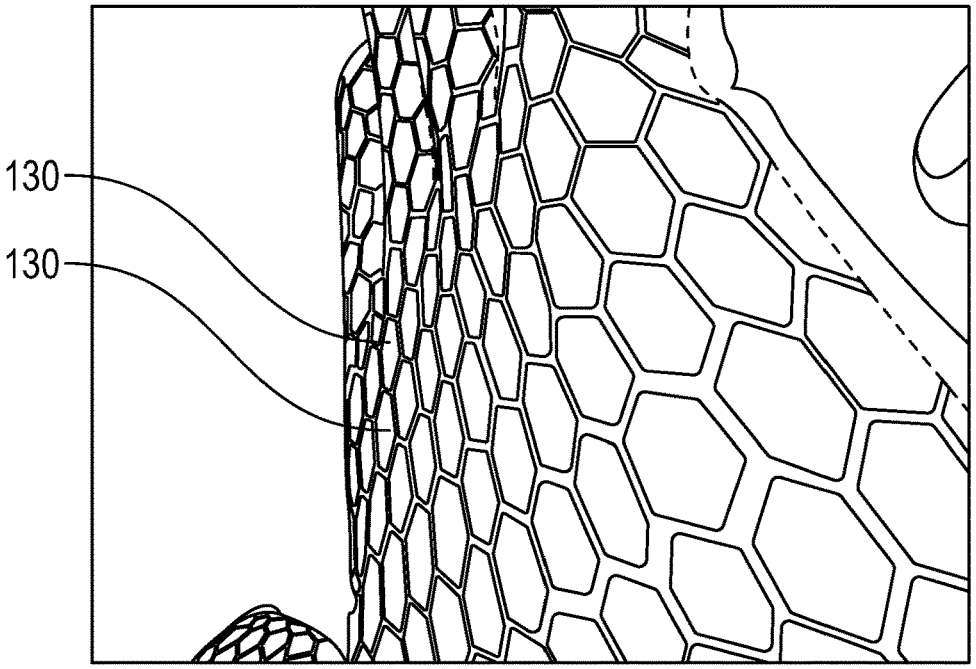
FIG. 5 is a close-up side perspective view of the embossed pattern of FIG. 3.
Figure 6:
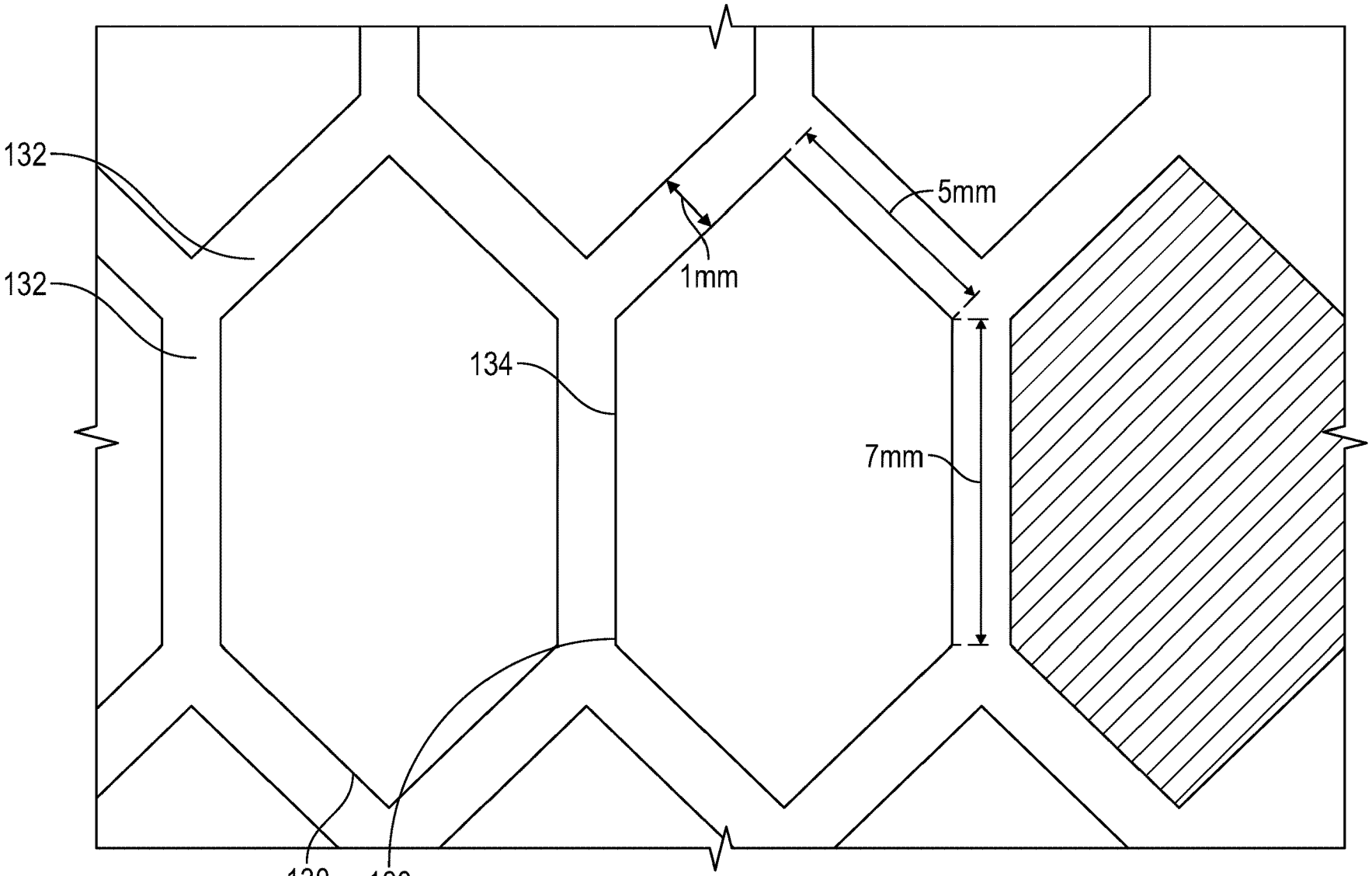
FIG. 6 is a close-up schematic view of a raised, six-sided pad for use in the embossed pattern of FIGS. 3-5 and showing exemplary dimensions.

FIGS. 1 and 2 show a palm side and a top side, respectively, of an athletic or sports glove 100 provided with a high-grip surface in accordance with certain aspects of an embodiment of the invention. While not shown in the Figures, the interior of the glove is preferably fabric, such as polyester or cotton, which will provide a comfortable fit against the wearer's skin. However, the outside of the glove is provided a panel of high-adherence material 110 extending along the palm side of glove 100, and a panel of flexible, stretchable fabric 150 extending along the top side of glove 100 (opposite the palm side). As discussed in greater detail below, the panel of high-adherence material 110 includes an embossed pattern and material that is particularly configured to (i) provide a high-grip surface while maintaining high tactile feedback or "feel" of the item being grasped (such as a football), while (ii) maintaining maximum flexibility in the hand so as to not impede the wearer's ability to conform their hand to the intended shape when varying their grip on the item being grasped.

With reference to FIGS. 1 and 3-5, panel of high-adherence material 110 extends across the palm side of glove 100. To provide a high-friction hold on anything grasped by glove 110, high-adherence material 100 is preferably formed of a high friction flexible polymer, such as in an exemplary configuration silicone, although polyurethane, polyvinyl chloride (PVC), or other similarly configured materials adapted to have a coefficient of friction of preferably 1.0 or greater may be employed. An embossing pattern, shown generally at 112 (and described in greater detail below), extends across the palm side of glove 100 from immediately adjacent the wrist end 102 of glove 100, across the palm of glove 100, and along the palm-facing side of each digit of the hand. Preferably, a notch 114 in the panel of high-adherence material 110 is provided between the base of the thumb and the base of the index finger and extends a short distance into the palm of glove 100 to ease relative movement of the thumb and index finger without bunching or resistance from high-adherence material 100.

Preferably, an un-embossed portion 116 of high-adherence material 100 extends around the upper side portions and top portions (opposite the palm side) of each of the index finger, middle finger, ring finger, and pinky, and similarly across the distal tips of each of the thumb, index finger, middle finger, ring finger, and pinky.

As best viewed in FIG. 2, the panel of flexible, stretchable fabric 150 covers the top side of the hand (opposite the palm side) and all digits up to just below the tips of the digits.

A strap portion 120 extends outward from the panel of high-adherence material 110 on the palm side adjacent the wrist end 102 of glove 100. Strap portion 120 includes a fastener 122(*a*) (e.g., hook-and-loop fastening material) which may be detachably joined to mating fastener 122(*b*) (e.g., a mating portion of hook-and-loop fastening material) on the top side of glove 100 adjacent wrist end 102.

As mentioned above, the panel of high-adherence material 110 comprises a pattern that is designed to (i) provide a high-grip surface while maintaining high tactile feedback or "feel" of the item being grasped (such as a football), while (ii) maintaining maximum flexibility in the hand so as to not impede the wearer's ability to conform their hand to the intended shape when varying their grip on the item being grasped. With regard to a particular embodiment, and with reference to FIGS. 3-5, such pattern comprises generally hexagonal or six-sided pads 130 spaced closely adjacent to one another but with sufficient distance between them to define channels 132 that provide sufficient flex in glove 100 so as to not impede the wearer's athletic performance. Channels 132 also define flow passages that allow moisture that may have collected on the item being grasped to tread away from the glove surface to further improve grip.

In a particularly preferred configuration that optimizes the foregoing functions, the longest dimension of each six-sided pad 130 is generally aligned with the longitudinal axis of the index finger, middle finger, ring finger, and pinky of glove 100. The two longest sides 134 of each hexagonal pad 130 are preferably 3.5 to 10.5 mm, and most preferably 7 mm. The four remaining sides of each hexagonal pad 130 are preferably 2.5 to 10 mm, and most preferably 5 mm. Each hexagonal pad preferably has an overall maximum length along its longitudinal axis of 7 to 21 mm, and most preferably 14 mm. Channels 132 between adjacent hexagonal pads 130 are preferably 0.5 to 1.5 mm, and most preferably 1 mm. Further, each hexagonal pad 130 has a thickness dimension (extending upward from the lowest portion of the face of the palm) of preferably 0.15 to 0.35 mm, most preferably 0.35 mm. Such configuration maximizes the grip between the palm of the glove and the equipment being grasped by the wearer, while also maximizing flexibility of that surface for ease of gripping movement of the wearer, with the minimal thickness of the pads in combination with such channels 132 maximizing the tactile feedback or feel that the wearer experiences when gripping the subject equipment.

A glove configured in accordance with the foregoing may provide a significantly improved grip in comparison to previously known sports gloves, while maintain maximum flexibility and tactile feedback so as to not impede on the player's performance or manipulation of their hand as intended to vary their grip on an item.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It should be understood, therefore, that the invention may be practiced otherwise than as specifically set forth herein.

What is claimed is:

1. A sports glove comprising: a palm side comprising a panel of high-adherence material having an embossed pattern thereon forming a plurality of separated, six-sided, raised pads; a top side opposite the palm side, the top side comprising a panel of flexible, stretchable fabric; and an interior fabric layer comprising at least one of polyester and cotton; wherein a longest length dimension of each of said separated, six-sided, raised pads is substantially aligned with a longitudinal axis of an index finger, middle finger, ring finger, and pinky finger digit of the glove; and wherein said panel of high-adherence material comprises a single panel extending width-wise across said palm side from a tip of a thumb digit of the glove to a side edge of the glove adjacent the pinky finger digit of the glove, wherein all of said separated, six-sided raised pads extend in a single aligned direction across said panel of high-adherence material.

2. The sports glove of claim 1, wherein an upper side portion of each of an index finger, middle finger, ring finger, and pinky finger digit of the glove further comprises a panel of high-adherence material further comprising an unembossed portion, and wherein said unembossed portion extends around said upper side portion of each of said index finger, middle finger, and pinky finger digit of the glove.

3. The sports glove of claim 2, wherein said unembossed portion further extends over a top side of a tip of each of the index finger, middle finger, ring finger, and pinky finger digits of the glove.

4. The sports glove of claim 1, wherein each said six-sided, raised pad has a width dimension extending upward from said palm side of up to 0.35 mm.

5. The sports glove of claim 1, wherein each said six-sided, raised pad has a pair of opposite sides having a length dimension of 2.5 to 10 mm.

6. The sports glove of claim 1, wherein each said six-sided, raised pad is separated from adjacent six-sided, raised pads by a channel having a channel width between 0.5 and 1.5 mm.

7. The sports glove of claim 1, further comprising a notch in said panel of high-adherence material, said notch extending toward a central interior of the palm side between a base of a thumb portion and a base of an index finger portion of the glove.

8. The sports glove of claim 1, wherein said high-adherence material further comprises a high friction flexible polymer.

9. The sports glove of claim 8, wherein said high friction flexible polymer is selected from the group consisting of silicone, polyurethane, and polyvinyl chloride.

* * * * *